US006059472A

United States Patent [19]

Yeh

[11] Patent Number: 6,059,472

[45] Date of Patent: May 9, 2000

[54] PEN STRUCTURE

[76] Inventor: Thomas Yeh, 10F, No.97, Sec.2, Nan-Kang Rd., Taipei, Taiwan

[21] Appl. No.: 09/069,081

[22] Filed: Apr. 28, 1998

[51] Int. Cl.[7] ..... B43K 23/02; B43K 23/08

[52] U.S. Cl. ..... 401/98; 401/88; 401/131; 401/202

[58] Field of Search ..... 401/88, 96, 98, 401/131, 202, 209; D19/42, 43, 47, 51, 53, 57; 15/427, 425, 426, 434, 424

[56] References Cited

U.S. PATENT DOCUMENTS

| | | | |
|---|---|---|---|
| D. 231,138 | 4/1974 | Ewry | D19/51 |
| D. 318,293 | 7/1991 | Flowers | D19/42 |
| D. 345,176 | 3/1994 | Monzyk | D19/42 |
| 385,448 | 7/1888 | Disney | 401/131 |
| 863,915 | 8/1907 | Graves | 401/98 |
| 1,647,536 | 11/1927 | Miller | 401/88 |
| 2,911,950 | 11/1959 | Freeman | 401/209 |
| 4,732,504 | 3/1988 | Telli | 401/98 X |
| 5,353,464 | 10/1994 | Atkins et al. | 401/6 X |
| 5,411,344 | 5/1995 | Gagne | 401/88 X |

FOREIGN PATENT DOCUMENTS

| | | | |
|---|---|---|---|
| 1101728 | 10/1955 | France | 401/131 |
| 546632 | 3/1932 | Germany | 401/88 |

*Primary Examiner*—Henry J. Recla
*Assistant Examiner*—Kathleen J. Prunner
*Attorney, Agent, or Firm*—Dougherty & Troxell

[57] ABSTRACT

A pen structure with a pair of leg seats formed on two end sections of the pen stem thereof is disclosed. A cap member is removably fitted with one end of the pen stem. The pen stem, leg seats and cap member are made of soft rubber material and together form the pen structure with a specific pattern.

4 Claims, 5 Drawing Sheets

PEN STRUCTURE

BACKGROUND OF THE INVENTION

The present invention relates to a pen structure in which a pair of leg seats are formed on two end sections of the pen stem. A cap member is removably fitted with one end of the pen stem. The pen stem, leg seats and cap member together form the pen structure with a specific pattern.

A conventional pen structure includes a pen stem made of rigid material and formed with an axial through hole for receiving a pen core for writing. In consideration of convenience in use, a rubber eraser is often additionally fitted with a tail end of the pen stem instead of a separate one for erasing ink or pencil marks.

In U.S. Pat. No. 5,709,491 issued to the applicant of the instant application, a pencil-like eraser made of rubber material is disclosed. In use, the rubber material enables the entire pen to serve as an eraser. This facilitates the use of the pen and enables a user hold the pen more comfortably.

SUMMARY OF THE INVENTION

It is a primary object of the present invention to provide a pen structure having a pen stem made of soft rubber material and a pair of leg seats disposed on two end sections of the pen stem. A cap member is removably fitted with one end of the pen stem. The pen structure not only serves as a general pencil or ball-point pen, but also can be rested on a desk as a decoration.

It is a further object of the present invention to provide the above pen structure in which the pen stem, leg seats and cap member are all made of soft rubber material. This enables a user hold the pen more comfortably. Also, the soft rubber material enables the pen to be directly used as an eraser for erasing ink or pencil marks.

It is still a further object of the present invention to provide the above pen structure in which the leg seats extend in a direction perpendicular to the axis of the pen stem, whereby when placed on a desk face, by means of the leg seats, the pen is prevented from freely rolling down.

The present invention can be best understood through the following description and accompanying drawings, wherein:

DETAILED DESCRIPTION OF THE PREFERRED EMBODIMENTS

Figure 1:
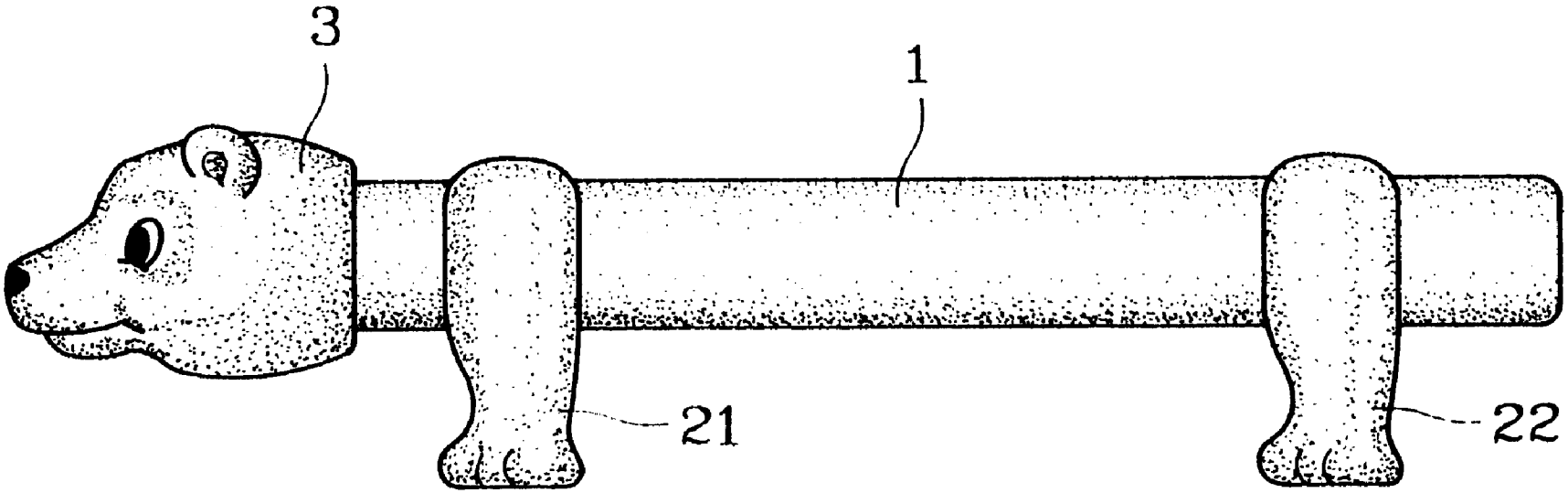
FIG. 1 is a side view of a first embodiment of the present invention.

Please refer to FIG. 1. According to a first embodiment, the pen structure of the present invention has an aspect of a certain animal pattern. However, the pattern of the pen structure can be freely varied without limitation to such aspect.

Figure 2:
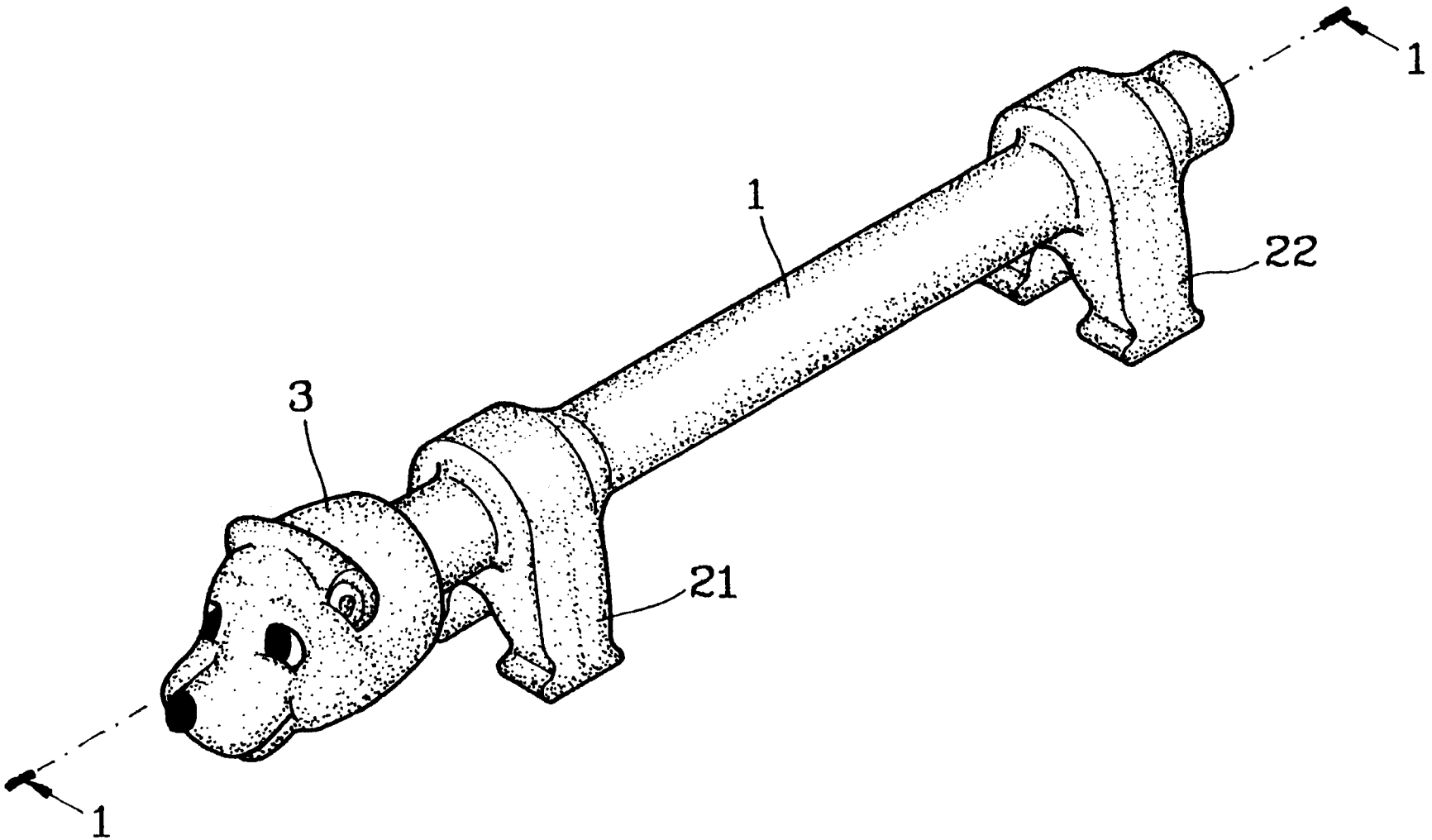
FIG. 2 is a perspective view of the first embodiment of the present invention.
Figure 3:
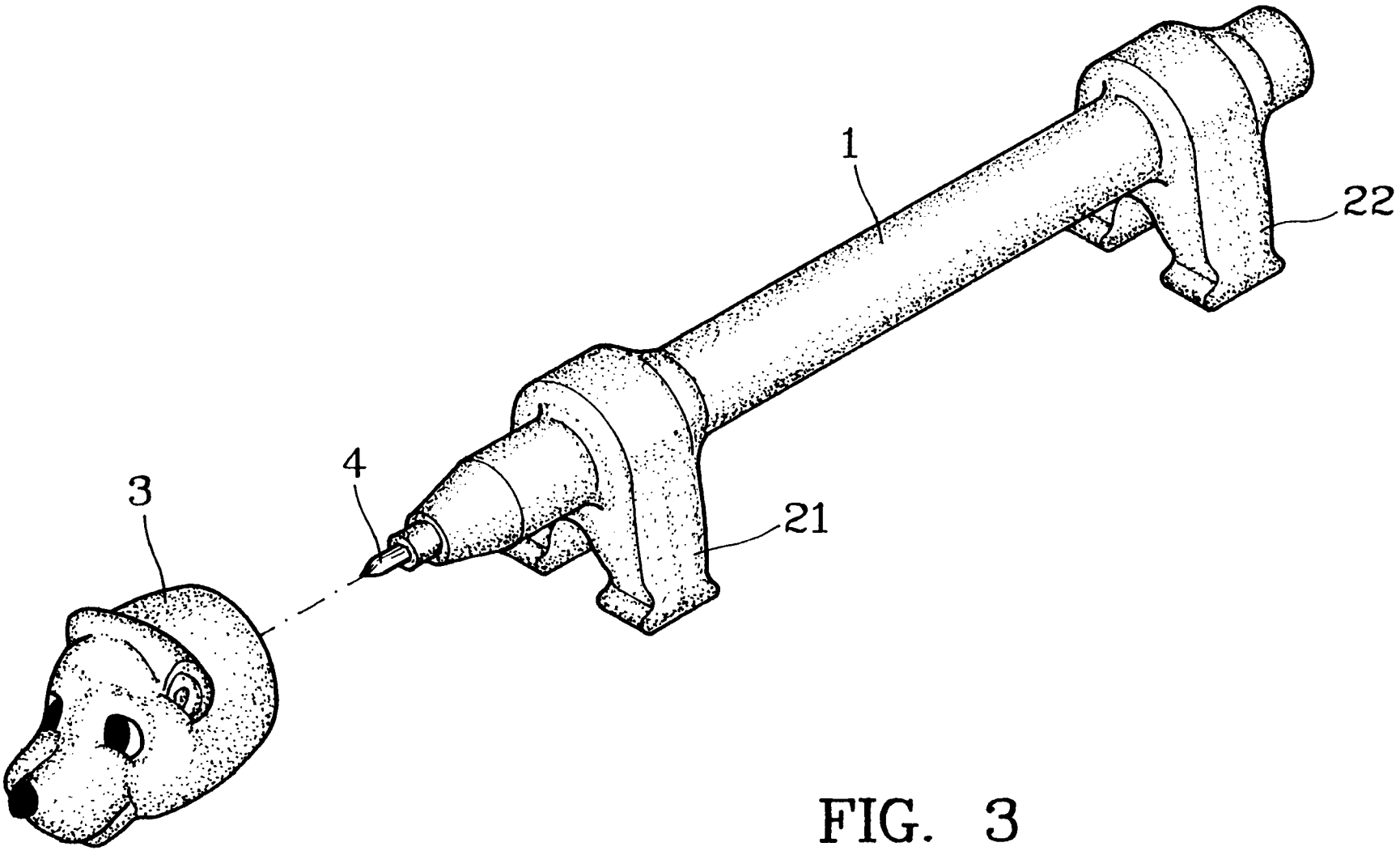
FIG. 3 is a perspective exploded view of the first embodiment of the present invention.

Referring to FIGS. 2 and 3, the pen structure includes a pen stem 1 made of soft rubber material. A pen core 4 is received in the pen stem 1 as shown in FIG. 3.

Two end sections of the pen stem 1 are respectively integrally formed with two leg seats 21, 22 which are also made of soft rubber material and extend in a direction perpendicular to the axis of the pen stem 1.

Figure 4:
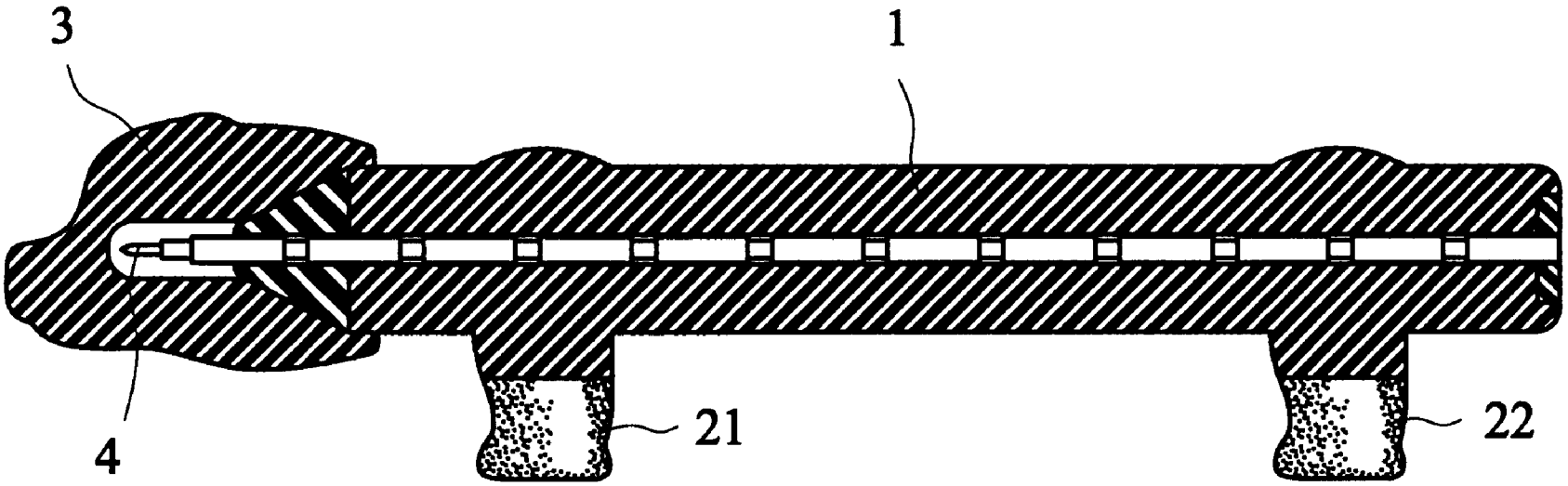
FIG. 4 is a sectional view taken along line 1—1 of FIG. 2.

A cap member 3 is removably fitted with a front end of the pen stem 1 as shown in FIG. 4. As a whole, the pen stem 1, leg seats 21, 22 and the cap member 3 together form the pen structure with a specific pattern.

According to the above first embodiment of the present invention, the pen structure not only serves as a general pencil or ball-point pen, but also can be rested on a desk as a decoration. Also, when placed on a plane desk face, by means of the leg seats, the pen structure is prevented from freely rolling down.

Figure 5:
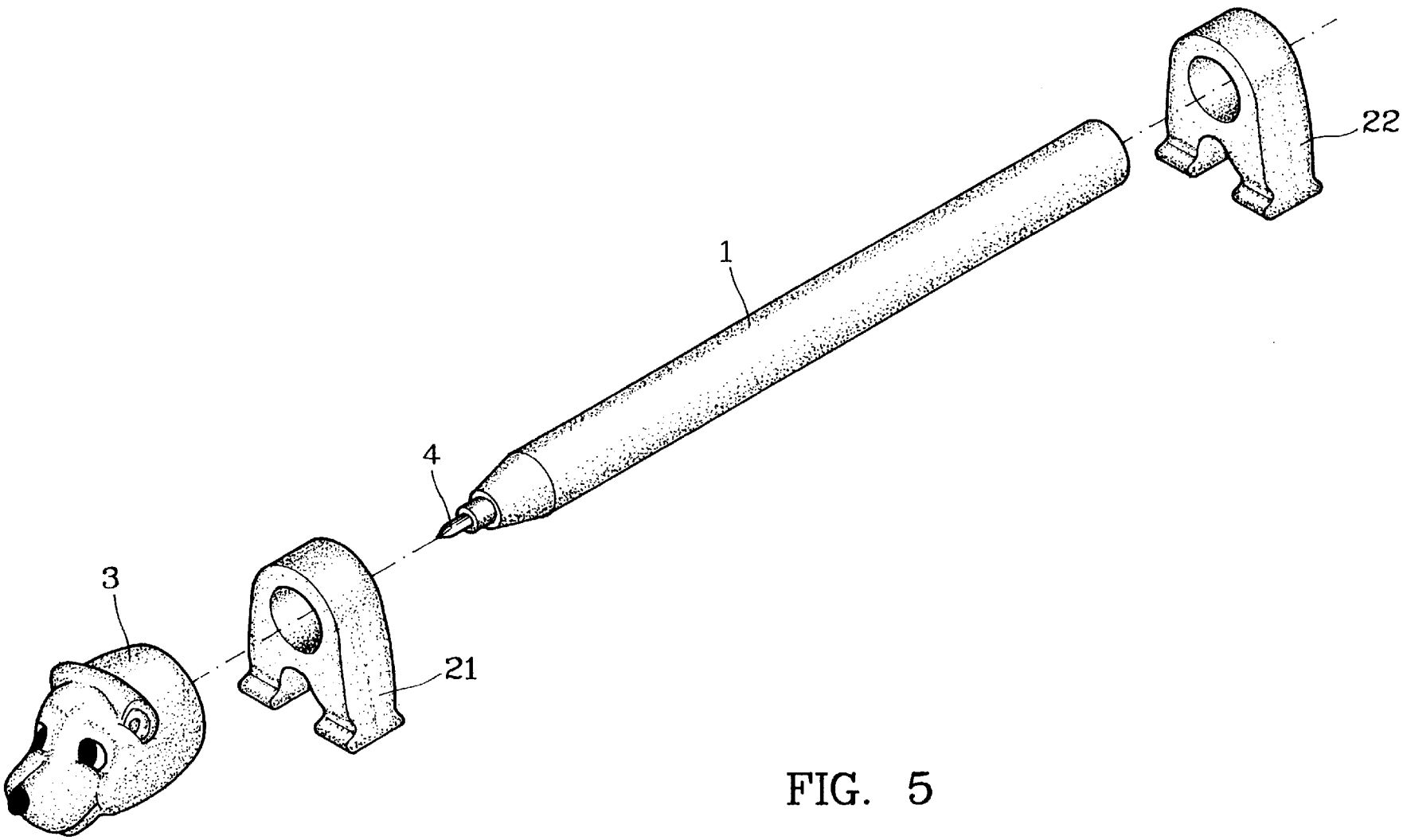
FIG. 5 is a perspective exploded view of a second embodiment of the present invention.

FIG. 5 shows a second embodiment of the present invention, in which most of the structure is identical to that of the first embodiment and denoted by the same reference numerals.

In FIG. 5, the leg seats 21, 22 are separably fitted with the pen stem 1. Each leg seat 21, 22 is formed with a fitting hole having a diameter equal to an outer diameter of the pen stem 1. Therefore, the leg seats 21, 22 are slidably fitted around the end sections of the pen stem 1.

It is noted from the description above, the pen structure of the present invention includes a pair of leg seats formed on two end sections of the pen stem thereof. A cap member is removably fitted with one end of the pen stem. The pen stem, leg seats and cap member are made of soft rubber material and together form the pen structure with a specific pattern.

It is to be understood that the above description and drawings are only used for illustrating some embodiments of the present invention, not intended to limit the scope thereof. Any variation and derivation from the above description and drawings should be included in the scope of the present invention.

What is claimed is:

1. A pen structure comprising:

a pen stem having opposite end sections;

a pen core received in the pen stem;

a pair of leg seats each comprising a pair of legs integrally formed on each of said opposite end sections of the pen stem, each pair of legs extending in the same direction laterally from said pen stem; and a cap member removably fitted with one end of the pen stem.

2. A pen structure as claimed in claim 1, wherein the pen stem, leg seats and cap member are made of soft rubber material.

3. A pen structure comprising:

a pen stem having opposite end sections;

a pen core received in the pen stem;

a pair of leg seats each having a fitting hole and a pair of legs extending in the same direction from said hole, the fitting hole having a diameter equal to an outer diameter of the pen stem, whereby the leg seats are slidably fitted around said opposite end sections of the pen stem, respectively, with each leg extending in the same direction; and a cap member removably fitted with one end of the pen stem.

4. A pen structure as claimed in claim 3, wherein the pen stem, leg seats and cap member are made of soft rubber material.

* * * * *